United States Patent [19]

Stubbins

[11] 4,367,059

[45] Jan. 4, 1983

[54] VARIABLE SIZED COIL CARRYING CAR

[75] Inventor: Derek Stubbins, Sheffield, England

[73] Assignee: Davy-Loewy Limited, Yorkshire, England

[21] Appl. No.: 209,517

[22] Filed: Nov. 24, 1980

[30] Foreign Application Priority Data

Nov. 30, 1979 [GB] United Kingdom ..... 7941416

[51] Int. Cl.[3] ..... B60P 7/12; B60P 9/00; B61D 3/16

[52] U.S. Cl. ..... 410/44; 198/488; 410/47; 410/49

[58] Field of Search ..... 198/487, 488; 410/36, 410/42, 44, 47, 48, 49

[56] References Cited

U.S. PATENT DOCUMENTS 3,168,206 2/1965 Washington ..... 410/44 X 3,262,664 7/1966 Paraskewik ..... 410/49

3,902,612 9/1975 Hall ..... 410/42 X

FOREIGN PATENT DOCUMENTS 2732977 2/1979 Fed. Rep. of Germany ..... 198/488

*Primary Examiner*—Robert B. Reeves
*Assistant Examiner*—Howard Beltran
*Attorney, Agent, or Firm*—Lee, Smith & Jager

[57] ABSTRACT

A transporter car for carrying a metal coil comprises a wheeled trolley with first and second supports for engaging the periphery of a coil to provide supports for the coil. The supports are arranged in side-by-side relation in the direction of movement of the trolley and one of the supports is retractable so that it can be used in combination with the other support for long coils and the other support is used on its own for short coils.

3 Claims, 3 Drawing Figures

VARIABLE SIZED COIL CARRYING CAR

Figure 1:
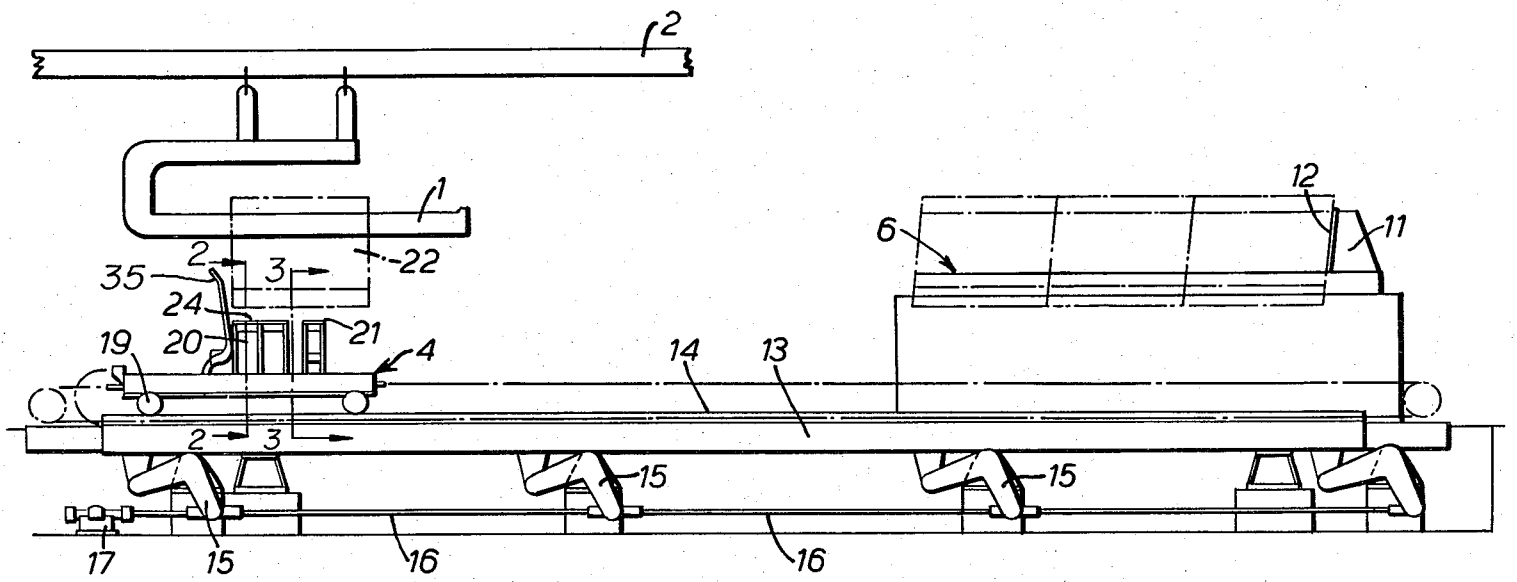

This invention relates to apparatus for transporting metal in coiled form.

In the metal forming art, it is well known to coil the metal, whether it is rod or strip, ready for further processing. It is also well known for the coils to be bound so that they cannot readily come apart and then to be transported from place to place.

The coils may be suspended from an overhead conveyor with the opening through the coil arranged substantially horizontal and with a conveyor support projecting through the opening so that a support surface engages the inner periphery of the coil. Alternatively, the coil may be transported, with the coil opening arranged substantially horizontal, on a transporter car. A support surface on the car engages the outer periphery of the coil. It is to a transporter car of this latter type that the present invention is particularly concerned.

A transporter car may be dimensioned so as to support coils of a particular fixed axial length, but in many applications the transporter car has to support coils of different axial lengths. If the transporter car has a support surface which is capable of supporting coils of the maximum length to be transported, then problems can occur when coils of less than the maximum axial length are supported on the transporter car. The main problem is concerned with removing coils from the transporter so that they are arranged on a support trestle in end-to-end abutting relation. When a first coil is present on the trestle and a second coil is transported on a car to the trestle, unless the end of the second coil which is adjacent the trestle projects beyond the support surface, the second coil cannot be positioned from the transporter car directly on to the trestle in abutting relation with the first coil. This is because the end of the support surface which is ahead of the coil abuts against the first coil and, when the second coil is deposited on the trestle, there is a space between the two coils. When a number of coils of metal rod are being positioned on the trestle support prior to their being formed into a pack, it is undesirable for there to be spaces between adjacent coils.

It is an object of the present invention to provide a transporter car in which the support surface is of adjustable length.

According to the present invention, a transporter car for conveying a coil of metal comprises a wheeled trolley, a first fixed support on the trolley for engaging the periphery of a coil to provide a support for the coil, a second support on the trolley for engaging the periphery of a coil to provide a support for the coil, said first and second supports being arranged side-by-side in the direction of movement of the trolley and the second support being displaceable between two positions in which the level of the second support is the same as that of the first support and below that of the first support respectively.

The total axial length of the first and second supports is arranged to be slightly less than the axial length of the maximum sized coils which are to be transported so that, when one of these coils is supported on the two supports, an end portion of the coil projects beyond the supports. For transporting smaller sized coils, the second support is displaced to a position where it does not support the coil and the first support is arranged to support the coil. The axial length of the first support is chosen to be less than the axial length of the smallest coils to be transported.

The second support conveniently includes a toggle mechanism by which the positions of the support level relative to the first support can be adjusted.

Figure 2:
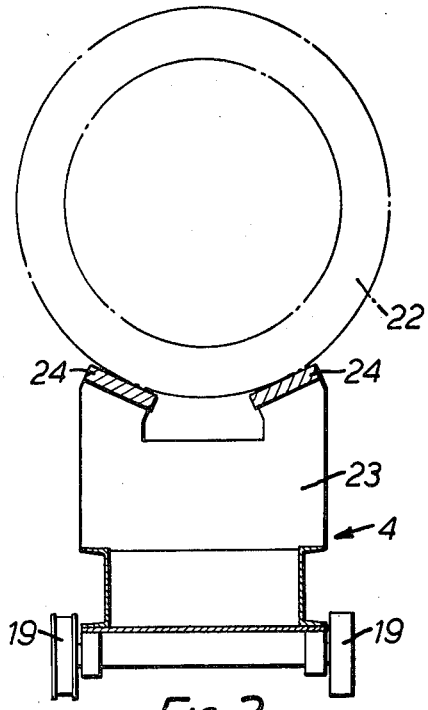
Figure 3:
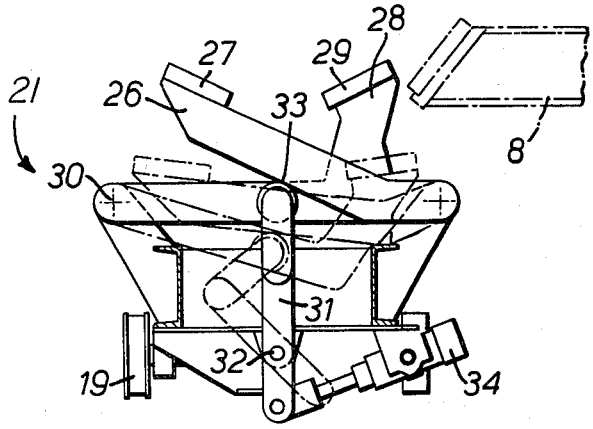

In order that the invention may be more readily understood it will now be described, by way of example only, with reference to the accompanying drawings, in which:

FIG. 1 is a side elevation of apparatus for arranging coils of metal rod in a pack and including apparatus in accordance with the present invention, FIG. 2 is a section on the line 2—2 of FIG. 1, and FIG. 3 is a section on the line 3—3 of FIG. 1.

Referring to FIG. 1, apparatus for forming a pack of coils of metal rod comprises a C-hook 1 suspended from and movable along an overhead gantry 2, a transporter car 4 and a support trestle 6.

The support trestle comprises a pair of stationary support plates 8 arranged in horizontal spaced apart relation. A fixed support plate 11 is at one end of the trestle and the plate provides a surface 12 which is inclined rearwardly from the support plate.

A beam structure 13 extends from a position beneath an unloading position of the C-hook 1 to a position beneath the support trestle. A track 14 is mounted on the beam structure. A plurality of pivoted bell crank levers 15 are spaced apart along the length of the beam structure and the levers are connected together by rods 16 which are coupled to a piston-cylinder device 17. On operating the device 17, the beam structure and the track 14 are raised and lowered by the bell crank levers.

The coil transporter 4 comprises a trolley on wheels 19 which are on the track 14. The transporter provides first and second supports 20 and 21 respectively for supporting a coil 22 of rod. The support 20 comprises three spaced apart plates 23 secured to the trolley and carrying a pair of support members 24 which extend horizontally and are engageable with the periphery of the coil. The second support 21 is retractable so that it can be used in combination with support 20 for long coils but can be retracted into a position where it is not used when shorter coils are to be supported.

Referring particularly to FIG. 3, a pair of arms 26 are pivotable about the trolley and carry a support pad 27 extending in the direction of movement of the trolley. An arm 28 positioned between the arms 26 carries a support pad 29 and is pivotable about a pivot 30 on the trolley.

A linkage 31 includes a two-part toggle pivoted to the trolley at 32 and to the arm 28. The linkage also includes a roller 33 which abuts against the underside of the arm 26. The lower end of the toggle linkage is connected to the piston of a piston-cylinder assembly 34. In the position shown in full lines in FIG. 3, the toggle linkage is straight and the arms 26 and 28 are elevated. The support surfaces of the pads 27, 29 are at the same level as the support surfaces of the pads 24. On operating the piston-cylinder assembly, the toggle linkage is broken, lowering arms 26 and 28 to the positions shown in broken lines.

In use, a coil 22 is brought to the loading station on a C-hook 1 and is positioned above the trolley 4. The actuating device 17 is actuated to cause the beam structure 13 to be raised, thereby raising the track 14 and the trolley 4 until the weight of the coil is taken on the supports 20, 21. The trolley is then traversed forward to take with it the coil 22 from the hook 1 and move the coil, with its longitudinal axis substantially horizontal, to the support trestle 6. The trolley continues to move forward until the coil engages against the inclined surface 12. The trolley is then stopped and the actuating device 17 causes the trolley to be lowered, thereby depositing the coil on the support 6 with the coil leaning forward against the inclined support surface 12. The weight of the coil is thus taken off the trolley which is free to be moved back to the loading station. A second coil is then supported on the trolley in the manner described above and this second coil is traversed forward on to the support 6 until the coil abuts against the previously deposited coil on the support. The trolley is then lowered so that the coil remains supported on the support abutting against the previously deposited coil. This is repeated until a plurality, say three coils, are similarly supported on the support, each leaning forward in the direction away from the loading station. The packs of coils so formed can then be removed from the support by an overhead crane or the like and the coils making up the pack can be secured together by fastening means extending around the pack of coils.

The trolley is conveniently provided with an upstanding flap 35 which is lowered during its direction of movement from the support 6 to the loading station but is thereafter raised and, as the trolley is moved forward beneath the coil supported on the hook 1, the flap 14 abuts against the coil to indicate that the trolley is beneath the coil. A signal from the flap causes the movement of the trolley to be stopped. The flap also causes the coil to be tilted slightly on the C-hook so that it can readily be removed from the hook.

Thus, for coils of short length, support 21 is retracted and the support 24 serves to support the coil when it is supported on the trolley, but for coils of longer length, the support 21 is raised so that the coil is supported on supports 24 and 21. The length of support 24 is arranged to be less than the length of the minimum length of coil to be transported and the total length of supports 21 and 24 is arranged to be less than the maximum length of coil to be transported so that, when a coil is carried on the transporter car, it has a portion which projects forward of the support(s).

I claim:

1. A transporter car for conveying a coil of metal with the longitudinal axis of the opening through the coil arranged substantially horizontal, comprising:

a wheeled trolley, a first structure on the trolley providing a fixed support situated in the direction of movement of the trolley which is capable of engaging the periphery of a coil with the longitudinal axis of the coil opening arranged substantially horizontal;

a second structure on the trolley and spaced from the first structure for providing a support capable of engaging the periphery of a coil to support the coil;

said first and second structures being arranged such that the supports are aligned and the total effective length of the supports in the direction of movement of the trolley is greater than the length of said first structure such that said first structure and second structure together are capable of supporting a coil of greater longitudinal length then said first structure alone; and means for displacing the support of the second structure relative to the trolley between a first position in which the first and second supports are in a coil carrying position and a second position in which the second support is in a retracted carrying position.

2. A transporter car as claimed in claim 1, in which the support of the second structure includes a pair of pads mounted one on each of a pair of pivoted arms and means are provided for pivoting said arms to displace the support between said two portions.

3. A transporter car as claimed in claim 2, in which the means for pivoting said arms comprises a first link pivoted to one of the arms and carrying a roller which abuts against the underside of the other arm, a second link pivoted to the first link and to the trolley and a piston-cylinder device arranged to pivot the second link relative to the trolley to thereby raise and lower the pivoted arms.

* * * * *